United States Patent [19]

Pachmayr et al.

[11] 4,286,401

[45] Sep. 1, 1981

[54] CUSHIONED GUN GRIP

[75] Inventors: Frank A. Pachmayr, Los Angeles; Jack R. Farrar, Whittier, both of Calif.

[73] Assignee: Pachmayr Gun Works, Inc., Los Angeles, Calif.

[21] Appl. No.: 32,170

[22] Filed: Apr. 23, 1979

[51] Int. Cl.[3] ..... F41C 23/00

[52] U.S. Cl. ..... 42/71 P

[58] Field of Search ..... 42/71 P

[56] References Cited

U.S. PATENT DOCUMENTS

| | | | |
|---|---|---|---|
| 2,034,632 | 3/1936 | Rice | 42/71 P |
| 4,148,149 | 4/1979 | Pachmayr et al. | 42/71 P |
| 4,162,586 | 7/1979 | Pachmayr | 42/71 P |

FOREIGN PATENT DOCUMENTS

| | | | |
|---|---|---|---|
| 1805399 | 8/1970 | Fed. Rep. of Germany | 42/71 P |

*Primary Examiner*—Charles T. Jordan

*Attorney, Agent, or Firm*—William P. Green

[57] ABSTRACT

A pistol grip preferably including a cushioning part having a rear portion extending across the back of a pistol handle and having side portions projecting forwardly from said rear portion at opposite sides of the handle, with the part desirably including a body of elastomeric material containing a reinforcing structure stiffer than the elastomeric material and of generally U-shaped horizontal sectional configuration. The cushioning part may be retained on the pistol handle by a fastener or fasteners extending forwardly through apertures in the back of the cushioning part and connectable to the pistol handle. The grip desirably includes a transversely extending cushioning strap preferably receivable in front of the pistol handle and formed at least in part of elastomeric material and having at least one and desirably two edge portions carrying lugs projecting inwardly toward the pistol handle into interfitting engagement with shoulders on the pistol handle to retain the lugs and attached edges of the strap against detaching movement relative to the handle. The transverse cushioning strap may be retained by reception of an edge portion thereof laterally between a side cushioning panel and the pistol handle, with that cushioning panel desirably being one of the side portions of a U-shaped cushioning part which extends across the back and along the opposite sides of the handle.

27 Claims, 12 Drawing Figures

CUSHIONED GUN GRIP

BACKGROUND OF THE INVENTION

This invention relates to improved cushioned grips to be applied to the handle of a pistol.

By removing from a pistol the usual rigid and hard handle grip structure ordinarily supplied therewith and substituting a cushioning grip having outer surfaces of elastomeric material which are slightly resiliently deformable, the comfort afforded to a user in firing the gun can be greatly enhanced. The cushioning material then absorbs some of the recoiling force exerted by the gun upon firing to reduce the discomfort resulting from transmission of that force to the user's hand. In addition, the slightly deformable cushioning grip surfaces allow for increased friction between the grip and the user's hand, and in that way improve the effectiveness with which the user can hold the gun in precisely aimed condition during firing. To attain these purposes, the present applicants have heretofore disclosed a number of different cushioned grip arrangements for use on different types of pistols, as shown in U.S. Pat. Nos. 3,672,084; 3,815,270; 4,043,066; and 4,132,024, and in U.S. patent applications Ser. No. 838,806 filed Oct. 3, 1977 on "Pistol with Cushioned Grip Safety", now U.S. Pat. No. 4,162,586, Ser. No. 872,329 filed Jan. 25, 1978 on "Cushioned Gun Grip", now U.S. Pat. No. 4,148,149, and Ser. No. 764 filed Jan. 3, 1979 on "Pistol Grip Having Cushioning Recesses".

SUMMARY OF THE INVENTION

The present invention provides another cushioned pistol grip arrangement which is specially adapted and constructed for optimum use with and attachment to a certain known type of pistol handle, or variations thereof. The grip of the invention is very easily applicable to such a handle, in a straightforward and positive manner, and after application is very effectively and positively retained against unintentional detachment from the handle or shifting movement relative thereto. The grip is of a type which may provide resilient cushioning surfaces entirely about the pistol handle, to cushion the contact between the user's hand and the handle at all points thereabout.

The present grip preferably includes a cushioning part of generally U-shaped horizontal section having a rear portion adapted to extend across the back of the pistol handle and having two side portions to be received at opposite sides of the handle. This U-shaped part may be connectable to the pistol handle by movement forwardly relative thereto, and by extension of one or more screws or other fasteners forwardly through apertures in the rear portion of the part for connection to the pistol handle. The U-shaped part desirably includes a body of elastomeric material having rear and side portions and containing a reinforcing structure which is stiffer than the elastomeric material and embedded therein and is of generally U-shaped horizontal section to extend across the back and along opposite sides of the pistol handle. This reinforcing structure may be formed as a single one piece metal stamping deformed to the discussed shape, and containing openings through which the elastomeric material extends to enhance the bond between it and the reinforcing stamping.

A further feature of the invention resides in the preferred provision of a transverse cushioning strap formed at least in part of elastomeric material and extending from one side of the gun handle to its opposite side, desirably at the front of the handle. This cushioning strap may have a connecting edge portion which is received at a side of the pistol handle and carries a lug or lugs projecting laterally inwardly to a position of engagement with a shoulder or shoulders on that handle blocking separating movement of the edge portion of the cushioning element relative to the handle. In the presently preferred form of the invention, the strap has two such edge portions at opposite sides of the handle, each having a lug or lugs of the discussed type.

A further feature of the invention resides in a unique interrelationship between a transverse cushioning strap and a side panel of a generally U-shaped cushioning part, in accordance with which a connecting edge of the transverse strap is confined between the side panel and the pistol handle, to maintain an interfitting relation holding the strap in place on the handle. In the preferred arrangement, each of two side panels of the U-shaped part retains a corresponding edge of the transverse strap in this manner to effectively lock the cushioning element on the handle without the necessity for fasteners directly connecting the strap to the handle. In another form of the invention, the transverse strap is integrally connected at one edge to a side panel of the U-shaped part, and has another edge which interfits with the other side panel when the grip is mounted on a gun.

BRIEF DESCRIPTION OF THE DRAWINGS

The above and other features and objects of the invention will be better understood from the following detailed description of the typical embodiments illustrated in the accompanying drawings, in which.

DESCRIPTION OF THE PREFERRED EMBODIMENTS

Figure 1:
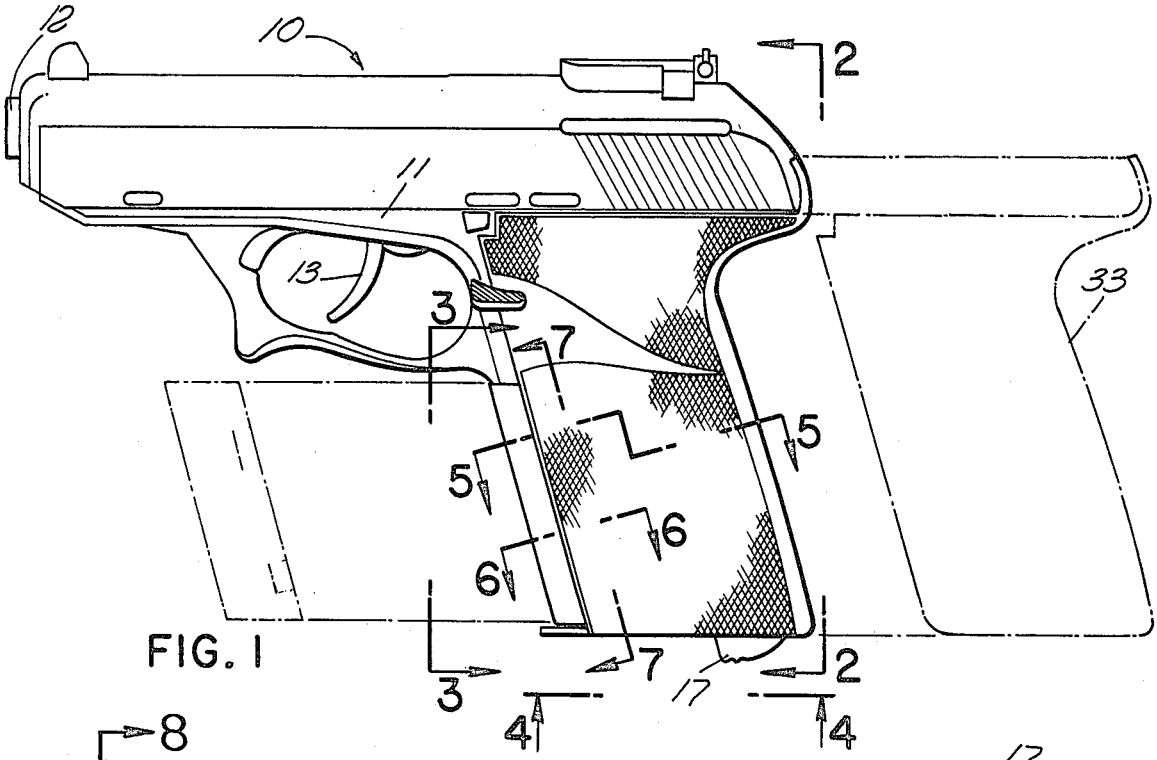
FIG. 1 is a side view of a pistol having a cushioned grip constructed in accordance with the invention.
Figure 2:
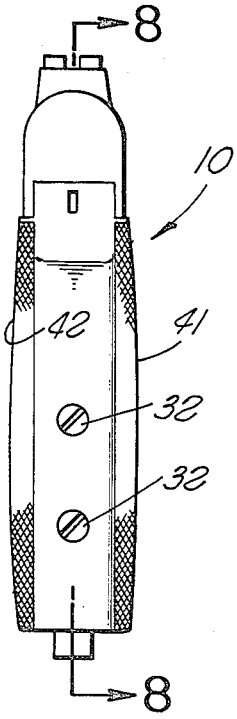
FIG. 2 is a rear elevational view taken on line 2—2 of FIG. 1.
Figure 3:
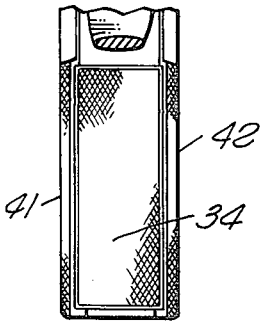
FIG. 3 is a front elevational view taken on line 3—3 of FIG. 1.
Figure 4:
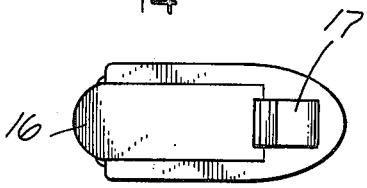
FIG. 4 is a fragmentary bottom plan view taken on line 4—4 of FIG. 1.
Figure 6:
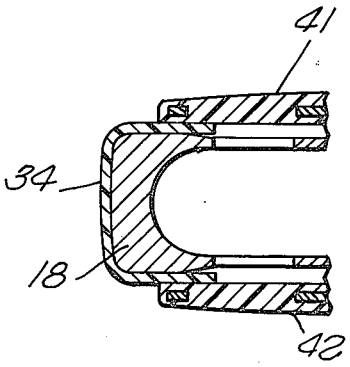
FIG. 6 is an enlarged fragmentary section taken on line 6—6 of FIG. 1.
Figure 7:
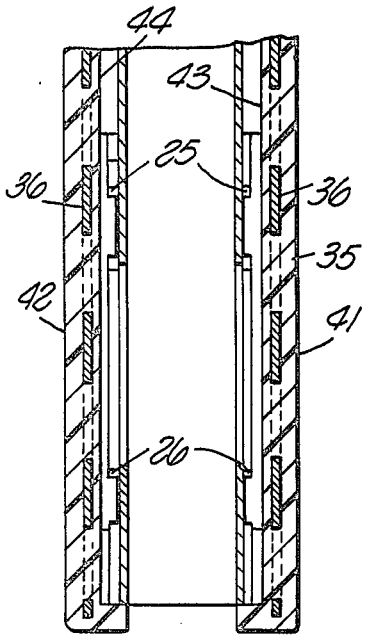
FIG. 7 is an enlarged fragmentary section taken on line 7—7 of FIG. 1.

The gun 10 illustrated in FIGS. 1 to 11 is a known conventional type pistol, having a frame 11 mounting a barrel 12 through which a bullet is fired under the control of a trigger 13. The handle structure 14 which projects downwardly from the rear portion of the frame contains a passageway 15 having the cross-section illustrated in FIG. 5 and which extends upwardly and slightly forwardly to receive a clip 16 containing a series of rounds of ammunition to be fed successively upwardly to the firing mechanism of the gun. The clip 16 and contained rounds are slidably insertable upwardly into passageway 15, and releasably retained in the handle by a spring-pressed latch element 17 mounted to the gun frame for pivotal movement about a transverse axis 117 against the tendency of a spring 217. When element 17 is manually swung rearwardly (counterclockwise about axis 117) from the full line position of FIG. 8 to the broken line position, this swinging movement releases clip 16 for downward sliding removal from the gun.

Figure 8:
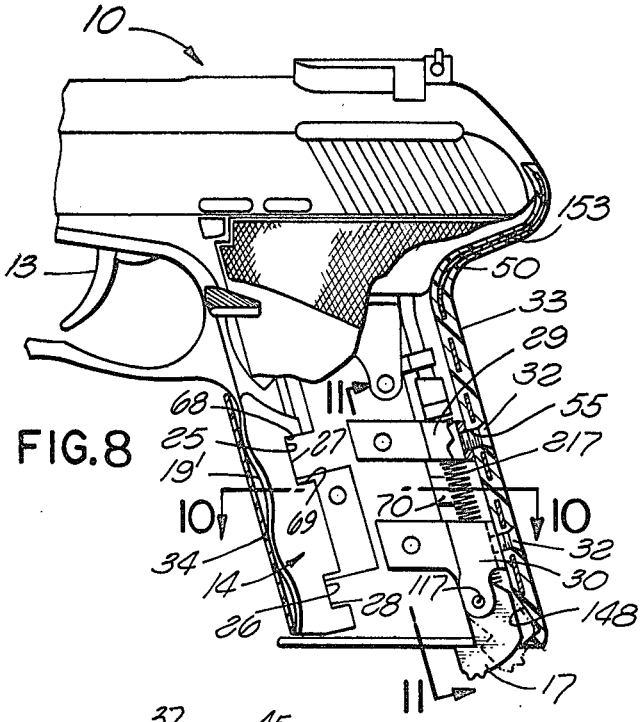
FIG. 8 is a vertical section taken primarily on line 8—8 of FIG. 2.
Figure 5:
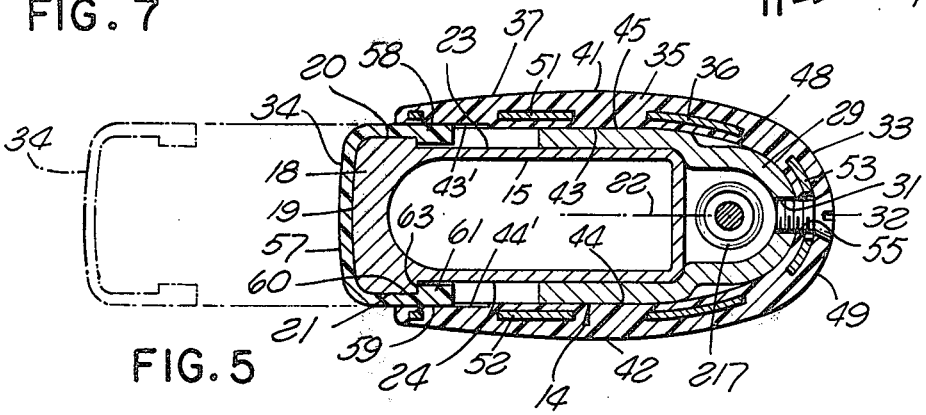
FIG. 5 is an enlarged generally horizontal section taken on line 5—5 of FIG. 1.

As seen in FIG. 5, the handle 14 of the gun may include a main forward section 18 having the cross-section illustrated in FIG. 5 and containing and defining the upwardly and forwardly extending cartridge feed passage 15, with this part 18 having a front surface 19 extending generally vertically but inclined slightly forwardly and containing shallow recesses 19' for reception of the fingers of a user during firing of the gun (see FIG. 8). At opposite sides of the front surface 19, part 18 has two parallel opposite side surfaces 20 and 21 extending rearwardly in planes parallel to and spaced equal distances from the central vertical front to rear plane 22 of the gun. Rearwardly beyond surfaces 20 and 21, the part 18 has a pair of parallel vertical opposite side surfaces 23 and 24, which are parallel to central vertical plane 22 and spaced equal distances therefrom, but are slightly closer to plane 22 than are surfaces 20 and 21. At the juncture of surfaces 20 and 23, part 18 is shaped to form two vertically spaced rectangular notches 25 and 26 (FIGS. 5, 7 and 8), defined by generally vertical front edge surfaces or shoulders 27 and 28 facing rearwardly, and generally horizontal top and bottom edge surfaces or shoulders 68 and 69, all of which surfaces 27, 28, 68 and 69 are utilized in the present arrangement for retaining one of the two parts of the grip on the gun handle.

At the back of the part 18, there are secured to that part a pair of U-shaped metal elements 29 and 30, having the generally horizontal cross section illustrated in FIG. 5, and which contain threaded bores 31 into which retaining screws 32 are threadedly connectable to secure a rear portion of the grip on the gun handle.

Figure 9:
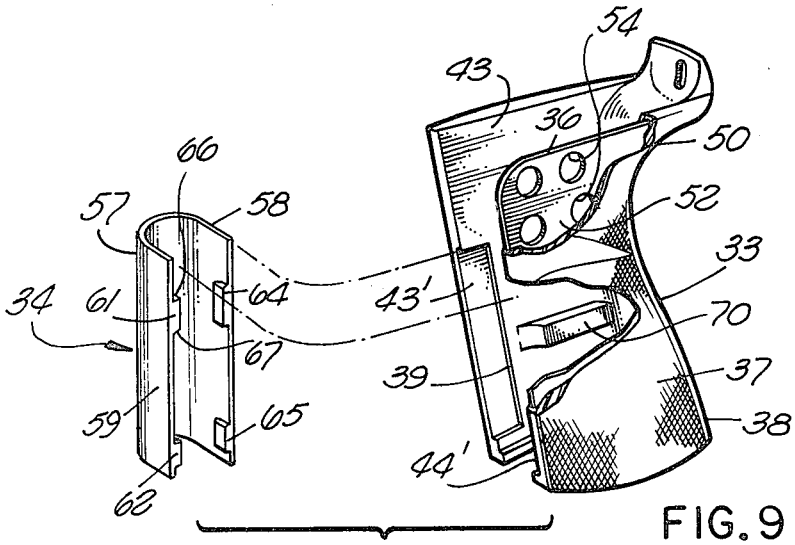
FIG. 9 is an exploded perspective view, partially broken away, showing the two cushioning parts of the present grip.
Figure 10:
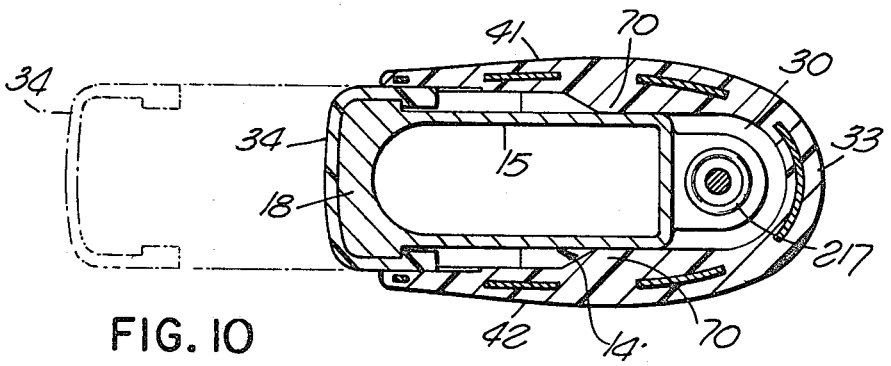
FIG. 10 is an enlarged horizontal section taken on line 10—10 of FIG. 8.
Figure 11:
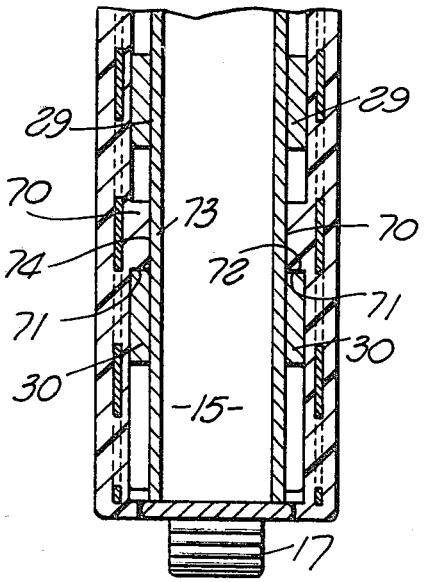
FIG. 11 is an enlarged fragmentary section on line 11—11 of FIG. 8.

The grip assembly of the present invention preferably includes a rear cushioning part 33 and a forward cushioning part or strap 34 (see FIG. 9). The rear part 33 is of generally U-shaped horizontal sectional configuration, as will be apparent from FIG. 5, and is formed of a body 35 of elastomeric material and a reinforcing structure or element 36 embedded therein. The elastomeric material may be rubber, preferably neoprene, desirably having a Shore hardness between about 35 and 45 on the A scale. The outer surfaces 37 of the elastomeric material are thus resiliently deformable under gripping force to deform slightly when a user grips the handle on firing the gun. These outer surfaces may be irregularized, as by checkering 38, to further enhance the effectiveness of the gripping contact.

The elastomeric material 35 is molded to form two opposite side panels 41 and 42 of that material which extend vertically and essentially parallel to one another and parallel to central vertical plane 22. At their inner sides, panels 41 and 42 have two vertical planar surfaces 43 and 44 engageable with outer vertical surfaces 45 of the gun handle, and may contain two shallow recesses 39 near the forward edges of the panels defined by vertical surfaces 43' and 44' disposed parallel to one another and to plane 22 and offset slightly laterally outwardly relative to surfaces 43 and 44. The outer surfaces of the panels are generally parallel to one another but may be slightly rounded as shown for maximum gripping comfort. At the back of the handle, the elastomeric body 35 curves about the rear side of the handle at 48, to present a curved rear surface 49 engageable by the user's hand and through which recoil is transmitted to the hand. At the upper end of the part 33, the elastomeric material 35 may be curved rearwardly as represented at 50 in FIG. 8, to follow the contour of the rear side of the upper portion of the gun frame. At the lower end of rear portion 48 of body 35, the elastomeric material of the body contains a forwardly facing recess 148 shaped to receive the lower rear portion of clip retaining element 17 as that element swings rearwardly to its broken line clip releasing position.

Reinforcing element 36 of the U-shaped part 33 is stiffer than the material of elastomeric body 35, to maintain the shape of the part 33 and prevent undue deformation of the elastomeric material. Preferably, reinforcing element 36 is substantially rigid, to remain permanently by its own stiffness in the configuration illustrated in the figures. Part 36 is desirably formed as a single one-piece metal stamping, shaped to have two parallel vertical opposite side portions or legs 51 and 52 which are parallel to and spaced equal distances from vertical plane 22, and which are embedded within the opposite side portions 41 and 42 of the elastomeric body 35. At the back of part 33, the metal stamping has a U-shaped curving portion 53 following the curvature of rear portion 48 of the elastomeric body, and extending about the back of the pistol handle, to integrally and rigidly interconnect the opposite side portions 51 and 52 of the reinforcing element. At the upper end of part 33, reinforcing element 36 follows the curvature of the elastomeric body as determined by the contour of the back portion of the gun frame, as represented at 153 in FIG. 8. As seen best in FIG. 9, the reinforcing element 36 contains apertures 54 spaced across its entire area, including the opposite side portions 51 and 52 and rear portion 53, so that the elastomeric material may extend through these apertures in a manner enhancing the bond between the metal and rubber. The two previously mentioned screws 32 at the back of the gun handle extend through two vertically spaced openings 55 extending through the rear crosspiece portion 48 of the elastomeric body 35 to secure part 33 to the gun handle. It is noted that at the locations of these apertures 55, the reinforcing element 36 has two apertures 56 within which the reduced dimension shanks of screws 32 are close fits, with the enlarged heads of screws 32 being of a diameter greater than that of openings 56 in the reinforcing element 36, so that the heads 32 can exert forward clamping force against the reinforcing element 36 about apertures 56 to apply retaining force to the reinforcing element. There may be a thin layer of elastomeric material at the locations of apertures 56 through which the screw heads thus apply force to the reinforcing material.

The front cushioning element or strap 34 may be molded from the same elastomeric material as is utilized in body 35 of rear part 33, and is preferably molded to the generally U-shaped horizontal configuration illustrated in FIGS. 5 and 9 but is resiliently distortable from that condition during application to a gun. Part 34 may be relatively thin and has a front generally vertical portion 57 received against the forward surface 19 of the gun handle. At opposite sides of the handle, part 34 has two parallel rearwardly extending vertical edge portions 58 and 59, which are received against opposite sides of the gun handle and which extend rearwardly to positions laterally between the gun handle and side panels 41 and 42 of part 33 and within recesses 39. More particularly, the portion 59 of part 34 is received and confined closely between surface 44' of left side panel 42 of the elastomeric body 38 of part 33 and the corresponding left side wall surface of the handle 14 of the gun, with the spacing between these parts at 60 corresponding to the thickness of element 34 at that point to confine the retained part of element 34 against lateral movement. Beyond this location 60 in a rearward direction (rightwardly in FIG. 5), the edge portion 59 of part 34 has two vertically spaced inwardly projecting lugs 61 and 62 (FIGS. 5, 7 and 9), which project inwardly toward the gun handle into two of the previously mentioned notches 25 and 26, and which have forwardly facing transverse surfaces 63 perpendicular to plane 22 and parallel to surfaces 27 and 28 of notches 25 and 26 to abut against those surfaces in a relation positively preventing forward movement (leftwardly in FIG. 5) of lugs 61 and 62 relative to the gun handle.

The lugs 61 and 62 may have the same generally rectangular configuration as notches 25 and 26, to fit closely within and be located by those notches, and are effectively retained within the notches in interfitting relation by engagement of part 33 with the outer surface of element 34. The upper and lower edge surfaces 66 and 67 of lugs 61 and 62 are parallel to shoulders 68 and 69 defining the tops and bottoms of the notches, and lie in planes perpendicular to central vertical plane 22, and are engageable with shoulders 68 and 69 to prevent upward or downward movement of the lugs or part 34 relative to the gun handle. The right side edge portion 58 of part 34 and the right half of part 33 are mirror images of the above discussed left portions of these parts, and interfit with one another and with the gun handle in the same manner as has been discussed above in detail in connection with portion 59 and panel 42. In particular, portion 58 is received within recess 43' in side panel 35, and has two vertically spaced lugs 64 and 65 of the same configuration as lugs 61 and 62 and projecting into a pair of notches 25 and 26 at the right side of the gun handle to interfit with the handle at that location in the same manner discussed in connection with lugs 61 and 62 and thus retain edge 58 in fixed position on the gun.

At locations rearwardly of recesses 43' the two side panels 41 and 42 of the elastomeric body of part 33 have projections 70 at their inner sides formed of the elastomeric material of those panels and projecting laterally inwardly at locations to be received vertically between the metal parts 29 and 30 of the gun handle. The undersurfaces 71 of projections 70 are horizontal and are engageable with upwardly facing horizontal top surfaces 72 of part 30 in a relation effectively retaining part 33 against downward movement relative to the handle. The inner vertical surfaces 73 of projections 70 are parallel to one another and to plane 22 and abut against correspondingly vertical planar surface 74 on the sides of the gun handle vertically between parts 29 and 30.

In mounting the grip of the present invention on gun 10, a user may first position the forward cushioning element 34 about the front of the gun handle, as by first holding part 34 in the forwardly displaced broken line position of FIGS. 1 and 5, and then moving part 34 rearwardly to the full line position of those figures, with the edges being spread slightly apart as element 34 moves rearwardly. In that full line position, the lugs 61, 62, 64 and 65 will be received in the notches 25 and 26 at opposite sides of the handle. With part 34 thus positioned, the user moves U-shaped rear cushioning part 33 forwardly from the broken line position of FIG. 1 to the full line position of that figure, with the opposite side portions 34 and 35 of part 33 sliding to the overlapping positions of FIG. 5 in which they are received outwardly of opposite edge portions 58 and 59 of part 34 and lock that part in its position of attachment to the handle, in which lugs 61, 62, 64 and 65 prevent movement of part 34 forwardly or upwardly or downwardly. As part 33 moves forwardly relative to the gun handle, elastomeric projections 70 slide forwardly along the upper surfaces of part 30, into interfitting relation therewith retaining part 33 against downward displacement relative to the handle.

After the parts 33 and 34 have been properly positioned on the handle, they are both retained by connection of screws 32 through the rear portion of part 33 into the gun handle. The two parts together then present elastomeric resiliently deformable cushioning surfaces engageable with a user's hand entirely about the handle of the gun, acting to increase the comfort and improve the effectiveness with which a user holds the gun.

Figure 12:
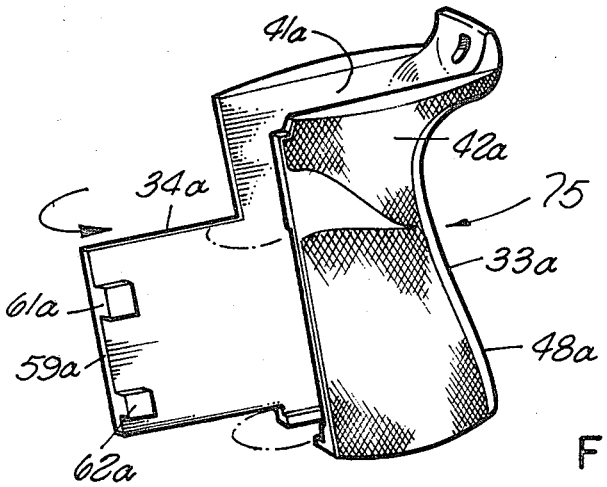
FIG. 12 is a perspective view of a variational form of the invention.

FIG. 12 shows a variational form of grip 75 which is essentially the same as that shown in FIGS. 1 to 11 except that the FIG. 12 device is formed as a single unitary part rather than as two separate parts. The rear portion 33*a* of the grip of FIG. 12 is a U-shaped structure corresponding to U-shaped part 33 of FIGS. 1 to 11, with two opposite side panels 41*a* and 42*a* of elastomeric material interconnected by a rear portion 48*a* at the back of the gun handle and containing a U-shaped metal reinforcing and stiffening part identical to that shown at 36 in FIGS. 1 to 11. The elastomeric flexible reinforcing strap 34*a* at the front of the handle in FIG. 12 is the same as strap 34 of FIGS. 1 to 11 except that in FIG. 12 the strap is permanently secured to the forward edge of side panel 41*a*, being molded integrally with the elastomeric material of part 33*a*. Lugs 61*a* and 62*a* are formed at the free edge 59*a* of flexible strap 34*a*, which may be identical with edge 59 and its carried lugs 61 and 62 in the first form of the invention.

In applying the device of FIG. 12 to a gun, part 75 is first positioned behind the gun handle and then moved forwardly about the handle, following which strap 34*a* is pulled across the front of the handle and forced rearwardly between left panel 42*a* and the left side of the handle until lugs 61*a* and 62*a* snap into place in recesses 25 and 26. Reception of the lugs in these recesses locks edge 59*a* against removal from between panel 42*a* and the gun handle, in which position strap 34*a* is held tightly against the front surface of the handle as in FIG. 5. The entire unit is retained on the gun by screws such as those shown at 32 in FIGS. 5 and 8 extending forwardly through the rear portion of the device into the gun handle.

While certain specific embodiments of the present invention have been disclosed as typical, the invention is of course not limited to these particular forms, but rather is applicable broadly to all such variations as fall within the scope of the appended claims.

We claim:

1. A pistol grip comprising:

a cushioning part to be received about a pistol handle and including a body of elastomeric material and a reinforcing structure embedded therein;

said body of elastomeric material forming a rear portion of the body adapted to extend across the back of said pistol handle and forming two side panels of said elastomeric material projecting forwardly from opposite side edges of said rear portion in spaced relation to be received at opposite sides of the pistol handle;

said reinforcing structure being of generally U-shaped horizontal sectional configuration forming a rear portion extending across the back of the pistol handle within said rear portion of the elastomeric body and forming two side portions projecting forwardly from opposite edges of said rear portion of the reinforcing structure and within said side panels of the elastomeric body in spaced relation and free of attachment to one another forwardly of said rear portion of the reinforcing structure;

said rear portion and said two side portions of said reinforcing structure all being stiffer than said elastomeric material and being interconnected in a relation maintaining said reinforcing structure by its stiffness in said U-shaped horizontal sectional configuration.

2. A pistol grip as recited in claim 1, in which said rear portion of the reinforcing structure contains at least one aperture for passing a fastener forwardly therethrough to attach said cushioning part to a pistol handle and against rearward removal therefrom.

3. A pistol grip as recited in claim 1, including at least one fastener adapted to extend forwardly through said rear portions of the elastomeric body and reinforcing structure to connect said cushioning part to a pistol handle; said rear portion of said reinforcing structure containing an aperture through which said fastener extends forwardly in a relation applying forward retaining force from the fastener to the reinforcing structure.

4. A pistol grip as recited in claim 1, in which said rear portion and said two opposite side portions of the reinforcing structure are formed integrally of a single piece of material.

5. A pistol grip as recited in claim 1, in which said rear portion and said two opposite side portions of the reinforcing structure are all essentially rigid and connected essentially rigidly together to remain without substantial deformation in said U-shaped horizontal sectional configuration.

6. A pistol grip as recited in claim 1, in which said rear portion and two side portions of said reinforcing structure are all formed as a single one-piece metal stamping containing openings through which said elastomeric material extends and having sufficient stiffness to remain essentially rigidly in U-shaped horizontal sectional configuration; said rear portions of the elastomeric body and reinforcing structure containing at least one aperture through which a fastener can extend forwardly to attach said cushioning part to a pistol handle.

7. A pistol grip as recited in claim 1, including a front cushioning strap formed at least in part of elastomeric material and adapted to extend across the front of the pistol handle between forward edges of said side panels.

8. A pistol grip as recited in claim 1, including a front cushioning strap formed at least in part of elastomeric material and formed separately from said cushioning part and adapted to extend across the front of the pistol handle between forward edges of said side panels.

9. A pistol grip as recited in claim 1, including a front cushioning strap formed at least in part of elastomeric material and adapted to extend across the front of the pistol handle between forward edges of said side panels, said strap being integrally connected to a forward edge of one of said side panels.

10. A pistol grip as recited in claim 1, including a front cushioning strap formed at least in part of elastomeric material and formed separately from said cushioning part and adapted to extend across the front of the pistol handle; said cushioning part being constructed to interfit with said front strap in a relation retaining said strap on the pistol handle.

11. A pistol grip as recited in claim 1, including a front cushioning strap formed at least in part of elastomeric material and formed separately from said cushioning part and adapted to extend across the front of the pistol handle; said front strap having an attaching portion received between said cushioning part and the pistol handle in a relation securing the strap to the pistol handle.

12. A pistol grip as recited in claim 1, including a front cushioning strap formed at least in part of elastomeric material and formed separately from said cushioning part and adapted to extend across the front of the pistol handle; said front strap having opposite edge portions extending rearwardly at opposite sides of the handle and each being received laterally between one of said side panels of the elastomeric body and the pistol handle in a relation retaining the strap on the handle.

13. A pistol grip as recited in claim 12, in which said opposite edge portions of said front cushioning strap have lugs projecting laterally inwardly toward the pistol handle and engageable with shoulders on the pistol handle in a relation retaining the lugs against forward movement and thereby interlocking said opposite edge portions of the strap against forward removal from between said elastomeric body and the pistol handle.

14. A pistol grip as recited in claim 1, including a front cushioning strap formed at least in part of elastomeric material and formed separately from said cushioning part and adapted to extend across the front of the pistol handle; said front strap having an attaching portion received laterally between said cushioning part and a side of the pistol handle and having a lug projecting laterally inwardly toward the pistol handle and engageable with a shoulder on the pistol handle in a relation retaining the lug against predetermined movement relative to the handle.

15. A pistol grip as recited in claim 1, in which said rear and side portions of the reinforcing structure are formed as a single one piece metal stamping having sufficient stiffness to remain rigidly in U-shaped horizontal sectional configuration and to retain said elastomeric body in essentially U-shaped horizontal sectional configuration; said metal stamping containing openings through which said elastomeric material extends; said cushioning part being removable rearwardly from about the pistol handle and containing at least one aperture extending through said rear portions of said elastomeric material and said reinforcing structure; there being a fastener adapted to extend forwardly through said aperture and to connect to the pistol handle and having a head of a diameter to apply forward clamping force to said reinforcing structure about said aperture to secure the cushioning part on the pistol handle; and a front cushioning strap formed at least in part of elastomeric material and adapted to extend across the front of the pistol handle and having two opposite edge portions to extend rearwardly at opposite sides of the pistol handle in positions of confinement laterally between the handle and said side panels respectively of said elastomeric body; said edge portions of said front strap having lugs projecting laterally inwardly toward the pistol handle at locations to engage forwardly and generally vertically against shoulders on the pistol handle and retain said edge portions against forward and generally vertical movement relative to said handle.

16. A pistol grip as recited in claim 1, including a front cushioning strap formed at least in part of elastomeric material and adapted to extend across the front of the pistol handle between forward edges of said side panels, said strap being integrally connected to a forward edge of one of said side panels and having an edge adapted to be retained laterally between the other of said side panels and the pistol handle.

17. A pistol grip as recited in claim 16, in which said edge of the strap has at least one lug projecting laterally inwardly toward the pistol handle at a location to engage a shoulder on the pistol handle in a relation retaining said edge of the strap against movement from between said other panel and said handle.

18. A pistol grip as recited in claim 1, in which said cushioning part is adapted to be positioned about the pistol handle by movement slidably forwardly relative thereto and has a projection at an inner side of at least one of said side panels projecting laterally inwardly and slidably movable to a position above a shoulder on said handle in a relation preventing downward movement of said part relative to the handle.

19. A pistol grip as recited in claim 1, in which said rear portion of the elastomeric body contains a recess at a forward side thereof near its lower end and beneath said rear portion of the reinforcing structure into which an ammunition clip retaining element is movable in a released position thereof.

20. A pistol grip comprising:

a front cushion formed at least in part of elastomeric material and adapted to extend across the front of a pistol handle from one side thereof to its opposite side and having an attaching portion which is adapted to extend rearwardly at one side of the handle and carries a lug projecting laterally inwardly toward the handle and receivable behind a shoulder on the handle in an interfitting position in which said shoulder blocks forward detaching movement of said attaching portion of the front cushion;

said front cushion being adapted to flex in a manner moving said attaching portion and said lug laterally toward and away from said handle and between said interfitting position behind the shoulder and an outer position in which the lug can move past said shoulder during assembly and disassembly; and a side panel adapted to be received at a side of the pistol handle and having a portion receivable laterally outwardly of said attaching portion of said front cushion at a location confining said attaching portion between said side panel and the pistol handle and preventing outward flexure of said attaching portion and lug from said interfitting position behind the shoulder to thereby prevent their forward detaching movement.

21. A pistol grip as recited in claim 20, in which said lug forms at least one generally horizontal shoulder engageable generally vertically with a shoulder on said handle of the gun to block generally vertical movement of the lug relative to the handle.

22. The combination comprising a pistol grip as recited in claim 20, and a pistol handle to which said front cushion and side panel are attached, with a shoulder on the pistol handle positioned forwardly of said lug.

23. A pistol grip as recited in claim 20, in which said front cushion has two of said attaching portions at opposite edges thereof adapted to extend rearwardly along opposite sides of the gun handle and each carrying a lug projecting laterally inwardly toward the handle and receivable behind a shoulder on the handle, said two attaching portions being adapted to flex away from one another during assembly and disassembly, there being two of said side panels received laterally outwardly of and confining and retaining said two attaching portions of the front cushion.

24. A pistol grip comprising:

a front cushion formed at least in part of elastomeric material and adapted to extend across the front of a pistol handle from one side thereof to its opposite side and having two attaching portions which are adapted to extend rearwardly at opposite sides of the handle and which carry lugs projecting laterally inwardly toward the handle and receivable behind shoulders on the handle in interfitting positions in which said shoulders block forward detaching movement of both of said attaching portions of the front cushion;

said attaching portions being adapted to flex laterally toward and away from one another and toward and away from said handle between said interfitting positions behind said shoulders on the handle and outer positions in which the lugs can move past said shoulders during assembly and disassembly; and a rear cushioning part of essentially U-shaped horizontal section formed at least in part of elastomeric material and having a rear portion to extend across the back of the pistol handle and two opposite side portions projecting forwardly from opposite edges of said rear portion for reception at opposite sides of the handle and connected to said rear portion for handling therewith as a unitary U-shaped cushioning part prior to and during application to the pistol handle;

said two opposite side portions of said rear cushioning part being adapted to be received laterally outwardly of said two attaching portions respectively of the front cushion at locations confining said attaching portions of the front cushion between said opposite side portions of the rear cushioning part and the pistol handle and preventing outward flexure of said attaching portions and lugs from interfitting positions behind the shoulders on the gun handle to thereby prevent forward detachment of the front cushion.

25. A pistol grip as recited in claim 24, in which said rear cushioning part has sufficient stiffness to remain by such stiffness in U-shaped horizontal sectional configuration.

26. A pistol grip as recited in claim 24, in which said U-shaped cushioning part is attachable to said pistol handle by movement slidably forwardly about the handle and to positions at outer sides of said attaching portions of the front cushion, there being at least one fastener adapted to extend forwardly through an aperture in said rear portion of said U-shaped rear cushioning part and to connect to the pistol handle to retain the rear cushioning part against rearward separating movement from the handle.

27. The combination comprising a pistol grip as recited in claim 24, and a pistol handle to which said front cushion and rear cushioning part are attached.

* * * * *